US006726777B1

(12) United States Patent
Sonoda et al.

(10) Patent No.: US 6,726,777 B1
(45) Date of Patent: Apr. 27, 2004

(54) CLEANING METHOD AND APPARATUS USING FLUID SPRAYING

(75) Inventors: Yuzuru Sonoda, Hidaka (JP); Toshiyuki Yamanishi, Nishitokyo (JP)

(73) Assignee: Sumitomo Heavy Industries Ltd., Tokyo (JP)

( * ) Notice: Subject to any disclaimer, the term of this patent is extended or adjusted under 35 U.S.C. 154(b) by 0 days.

(21) Appl. No.: 10/018,741

(22) PCT Filed: May 16, 2000

(86) PCT No.: PCT/JP00/03129

§ 371 (c)(1),
(2), (4) Date: Dec. 21, 2001

(87) PCT Pub. No.: WO01/00336

PCT Pub. Date: Jan. 4, 2001

(30) Foreign Application Priority Data

Jun. 24, 1999 (JP) ..... 11/177670

(51) Int. Cl.[7] ..... B08B 7/00

(52) U.S. Cl. ..... 134/7; 134/6; 134/25.4; 134/34; 134/36; 134/37; 134/42; 134/902; 134/198; 134/199; 134/200; 451/75; 451/99; 451/102

(58) Field of Search ..... 134/6, 7, 25.4, 134/34, 36, 37, 42, 902, 199, 198, 200; 451/38, 39, 75, 99–102

(56) References Cited

U.S. PATENT DOCUMENTS

| | | | | | |
|---|---|---|---|---|---|
| 5,062,898 | A | * | 11/1991 | McDermott et al. | 134/7 |
| 5,931,721 | A | * | 8/1999 | Rose et al. | 451/89 |
| 6,036,581 | A | * | 3/2000 | Aoki | 451/39 |
| 6,050,884 | A | * | 4/2000 | Togawa et al. | 451/67 |
| 6,295,999 | B1 | * | 10/2001 | Bran | 134/1.3 |

FOREIGN PATENT DOCUMENTS

| | | | |
|---|---|---|---|
| JP | 60-95991 | | 6/1985 |
| JP | 63-22558 | | 5/1988 |
| JP | 401259536 | A * | 10/1989 |
| JP | 9-213669 | | 8/1997 |
| JP | 2739926 | | 1/1998 |
| JP | 10-163154 | | 6/1998 |
| JP | 10-172944 | | 6/1998 |
| JP | 2828891 | | 9/1998 |
| JP | 10-326763 | | 12/1998 |
| JP | 11-300293 | | 11/1999 |
| JP | 200252249 | A * | 9/2000 |

* cited by examiner

*Primary Examiner*—Randy Gulakowski
(74) *Attorney, Agent, or Firm*—Arent Fox Kintner Plotkin & Kahn, PLLC

(57) ABSTRACT

Cleaning fluid is sprayed upwards from under a substantially horizontally-held object to be cleaned for cleaning the underside of the object. At this time, an accelerating fluid accelerates the cleaning fluid to change its spraying direction toward a surface of the object, then the cleaning fluid is sprayed onto the surface to be cleaned.

14 Claims, 8 Drawing Sheets

FIG. 1 "BACKGROUND ART"

FIG.2 "BACKGROUND ART"

"BACKGROUND ART"

"BACKGROUND ART"

"BACKGROUND ART"

"BACKGROUND ART"

CLEANING METHOD AND APPARATUS USING FLUID SPRAYING

TECHNICAL FIELD

The present invention relates to a method and apparatus for cleaning by spraying a cleaning fluid such as an aerosol containing argon particles toward a surface to be cleaned of an object to be cleaned such as a semiconductor wafer.

BACKGROUND ART

Particles or other contaminants on a surface of a semiconductor wafer in the LSI manufacturing process, and on a surface of a liquid crystal display (LCD), a solar cell, or the like, have a direct bearing on product yields, and therefore surface cleaning of wafers or the like is a crucial step.

Various surface cleaning methods have thus been devised. In the semiconductor manufacturing process, for example, wet bath cleaning methods have been most commonly used, in which objects to be cleaned are cleaned with pure water with the application of ultrasonic wave, or immersed in solutions containing cleaning agents (for example, hydrogen peroxide and ammonium hydroxide, or hydrogen peroxide and sulfuric acid) in pure water.

However, these wet bath-cleaning processes require an extensive site occupied by various pieces of equipment, and proper processing of disposed solutions. Consequently, there has been a desire to move toward a more environmentally friendly cleaning method without disposing any solutions or the like because of the recent increasing need of protecting the environment.

One of the dry cleaning methods, which don't utilize liquids, utilizes chemical reactions by applying a gas, but contaminants in the form of particles can hardly be removed by this method.

Another dry cleaning method may involve colliding particles of dry ice, ice, or solid argon with a surface to be cleaned to remove contaminating particles. However, cleaning with ice particles has the risk of damaging the surface which is being cleaned, and dry ice poses the problem of secondary contamination, because most dry ice products available on the market are made from exhaust gas produced through steel processing or oil refining and the dry ice itself is often contaminated.

On the other hand, the surface cleaning methods disclosed in Japanese Patent Laid-Open Publication Nos. Hei. 6-252114 and Hei. 6-295895, in which an aerosol containing solid argon particles (referred to as "argon aerosol") is collided with an object in a depressurized atmosphere, do not pose the above-described problems.

FIG. 1 is a piping diagram of the entire construction of one example of a wafer cleaning apparatus using the argon aerosol. FIG. 2 is a plan view of the same, and FIG. 3 is a longitudinal cross-section of a cleaning chamber.

Mass flow controllers 30, 32 are provided for respectively adjusting the flow rates of argon gas and nitrogen gas. The argon gas and nitrogen gas are passed through a filter 34 and cooled within a heat exchanger 38 using, for example, a helium (He) cryocooler 36, after which they are ejected into a cleaning chamber 42 for cleaning a wafer, as an aerosol 24 from a large number of fine orifices 22 formed in a cleaning nozzle 20. Inside the cleaning chamber 42 is created a vacuum by a vacuum pump 40.

The wafer 10 rests on a process hand 46, which is moved in directions along the X- and Y-axes by a wafer scan mechanism 44 (therefore is referred to also as an "X-Y scan stage"), so that the entire surface of the wafer can be cleaned.

It has been devised to provide an acceleration nozzle 56 for supplying a gas to increase the speed of the aerosol so as to enhance the cleaning effect. Thus, nitrogen gas (referred to accelerating gas 58) is supplied to the acceleration nozzle 56 through a mass flow controller 52 and a filter 54, and is blown out from nozzle orifices, accelerating the aerosol 24 ejected from the cleaning nozzle 20, as illustrated in FIG. 4.

It has also been suggested that nitrogen gas be introduced as a purge gas 66 into the cleaning chamber 42 through a mass flow controller 62 and a filter 64 from one end (left hand side of FIG. 2) of the cleaning chamber 42, so as to prevent particles that have been removed from being deposited again onto the wafer surface.

Reference numeral 50 in FIG. 3 represents a shield for controlling the gas flow within the cleaning chamber 42.

Cassettes 72 accommodating wafers 10 are loaded from the outside of the apparatus into cassette chambers 70, in which a vacuum is drawn. The cassette chambers 70 are provided in a pair as shown in FIG. 2 for the exchange of cassettes 72. Within a robot chamber 80 (or a transfer chamber) is installed a vacuum transfer robot (referred to also as a vacuum robot) 82, having a robot arm 84 and a robot hand 86 mounted at the distal thereof. The wafers 10 are transferred by the robot hand 86 through gate valves 74, 76 onto the above-mentioned process hand 46 within a buffer chamber 90, which is used for transferring the wafer 10 into the cleaning chamber 42.

The process hand 46 is driven by the wafer scan mechanism 44 to move the wafer 10 thereon from the buffer chamber 90 into the cleaning chamber 42, and in directions along the Y-axis and the X-axis under the cleaning nozzle 20.

The front surface of the wafer 10 is thus cleaned entirely by the aerosol 24 ejected from the cleaning nozzle 20. Thereafter, the cleaned wafer 10 is returned to the cassette chamber 70 through the buffer chamber 90 in reverse motions.

Meanwhile, the increasing demand for higher performance of semiconductor wafers in recent years has highlighted various problems. For example, there is the problem, which the conventional wet bath cleaning method cannot resolve, that the front side of the wafer may be re-contaminated by the contaminants or particles on the backside of the wafer transferring onto the front side of the wafer. Even the cleaning method using aerosol has the problem of particles that have been sputtered away from the front side of the wafer depositing onto the backside of the wafer.

The conventional aerosol cleaning method involves only the cleaning of the upper surface (or front surface) of the wafer 10 by spraying an aerosol 24 containing solid fine particles ejected from the cleaning nozzle 20 from above the wafer 10 downwards, as shown in FIG. 1. This is because the cleaning fluid is an aerosol, which contains microscopic particles of a solid or a liquid that are strongly affected by gravity. Thus it has not been proposed to clean the lower surface (or backside) of the wafer 10 using an aerosol.

When cleaning a semiconductor wafer with the above-described wafer cleaning apparatus using an aerosol, it is preferable that the aerosol 24 be delivered obliquely toward the downstream of the flow of purge gas as shown in FIG. 4, in the case in which no apertures such as via holes are formed in the wafer 10. However, when the wafer has via holes 12 as shown in FIG. 5 or other surface irregularities to be cleaned, the aerosol 24, if delivered obliquely, can hardly reach inside of etched concavities as shown in FIG. 5. In this case, therefore, it would be more preferable to direct the aerosol vertically as shown in FIG. 6.

On the other hand, when the number of residual particles on the wafer after cleaning matters most, the aerosol should be delivered toward the wafer at an inclined angle as shown in FIG. 4, so as not to disturb the flow of purge gas.

To solve the above-described problems, the ejection angle of the aerosol 24 could be varied by making the mounting angle of the cleaning nozzle 20 adjustable. This will, however, bring about the following problems:

(1) There will be limitations on the angle of ejection because of the liquid argon within the cleaning nozzle 20;

(2) The adjusting mechanism will be considerably complex because of the necessity to cool the cleaning nozzle 20 to a temperature as low as near that of liquid nitrogen; and (3) Varying of the angle of the cleaning nozzle 20 during cooling will cause a change in the condition within the nozzle, resulting in unstable discharge of the aerosol 24.

DISCLOSURE OF THE INVENTION

The present invention has been devised to solve the above-described problems in the prior art, and it is a first object of the invention to enable removal of contaminants or particles from the underside of an object to be cleaned.

A second object of the present invention is to achieve cleaning of both the upper side and the lower side of an object to be cleaned at the same time, so that contaminants or particles sputtered away from the surface being cleaned will not be deposited on the opposite side of the object to be cleaned.

A third object of the present invention is to make the direction of cleaning fluid toward a surface of the object to be cleaned adjustable without changing the mounting angle of cleaning nozzle.

The present invention provides a method of cleaning by spraying a cleaning fluid to a surface to be cleaned of an object to be cleaned, wherein a lower side of the substantially horizontally-held object to be cleaned is cleaned by spraying the cleaning fluid upwards from below the object to be cleaned toward the lower side of the object to be cleaned, thereby achieving the above-mentioned first object.

The object to be cleaned may be a semiconductor wafer.

Also, the cleaning fluid may be an aerosol containing argon particles.

Furthermore, the cleaning fluid may be accelerated by an accelerating fluid before being sprayed onto the surface to be cleaned.

Also, the spraying direction of the cleaning fluid toward the surface to be cleaned may be changed by the accelerating fluid.

In addition, the accelerating fluid may be ejected at variable speeds and in variable directions for controlling the spraying direction of the cleaning fluid toward the surface to be cleaned.

The present invention further provides a method of cleaning by spraying a cleaning fluid to a surface to be cleaned of an object to be cleaned, wherein a lower side and an upper side of the substantially horizontally-held object to be cleaned are cleaned at the same time by spraying the cleaning fluid upwards from below the object to be cleaned toward the lower side of the object to be cleaned and by spraying the cleaning fluid downwards from above the object to be cleaned toward the upper side of the object to be cleaned, thereby achieving the above-mentioned second object.

The present invention further provides a method of cleaning by spraying a cleaning fluid to a surface to be cleaned of an object to be cleaned, wherein the cleaning fluid is accelerated by an accelerating fluid, and caused to change its spraying direction toward the surface to be cleaned, before being sprayed onto the surface to be cleaned, thereby achieving the above-mentioned third object.

To achieve the above-mentioned first aim, the present invention further provides an apparatus for cleaning by spraying a cleaning fluid to a surface to be cleaned of an object to be cleaned, the apparatus having means for holding the object to be cleaned substantially horizontally, and a cleaning nozzle for spraying the cleaning fluid upwards from below the object to be cleaned against a lower side of the substantially horizontally-held object to be cleaned.

The apparatus may further include an acceleration nozzle for accelerating the cleaning fluid ejected from the cleaning nozzle.

The apparatus may further include means for changing the speed and the direction of the accelerating fluid ejected from the acceleration nozzle.

To achieve the above-mentioned second object, the present invention further provides an apparatus for cleaning by spraying a cleaning fluid to a surface to be cleaned of an object to be cleaned, the apparatus having means for holding the object to be cleaned substantially horizontally, a lower side cleaning nozzle for spraying the cleaning fluid upwards from below the object to be cleaned to a lower side of the substantially horizontally-held object to be cleaned, and an upper side cleaning nozzle for spraying the cleaning fluid downwards from above the object to be cleaned to an upper side of the object to be cleaned.

To achieve the above-mentioned third object, the present invention further provides an apparatus for cleaning by spraying a cleaning fluid to a surface to be cleaned of an object to be cleaned, the apparatus having means for holding the object to be cleaned, a cleaning nozzle for spraying the cleaning fluid onto the surface to be cleaned of the object to be cleaned, and an acceleration nozzle for ejecting an accelerating fluid for changing the direction of the cleaning fluid ejected from said cleaning nozzle toward the surface to be cleaned.

BEST MODE FOR CARRYING OUT THE INVENTION

Embodiments of the present invention will be hereinafter described in detail with reference to the drawings.

Figure 7:
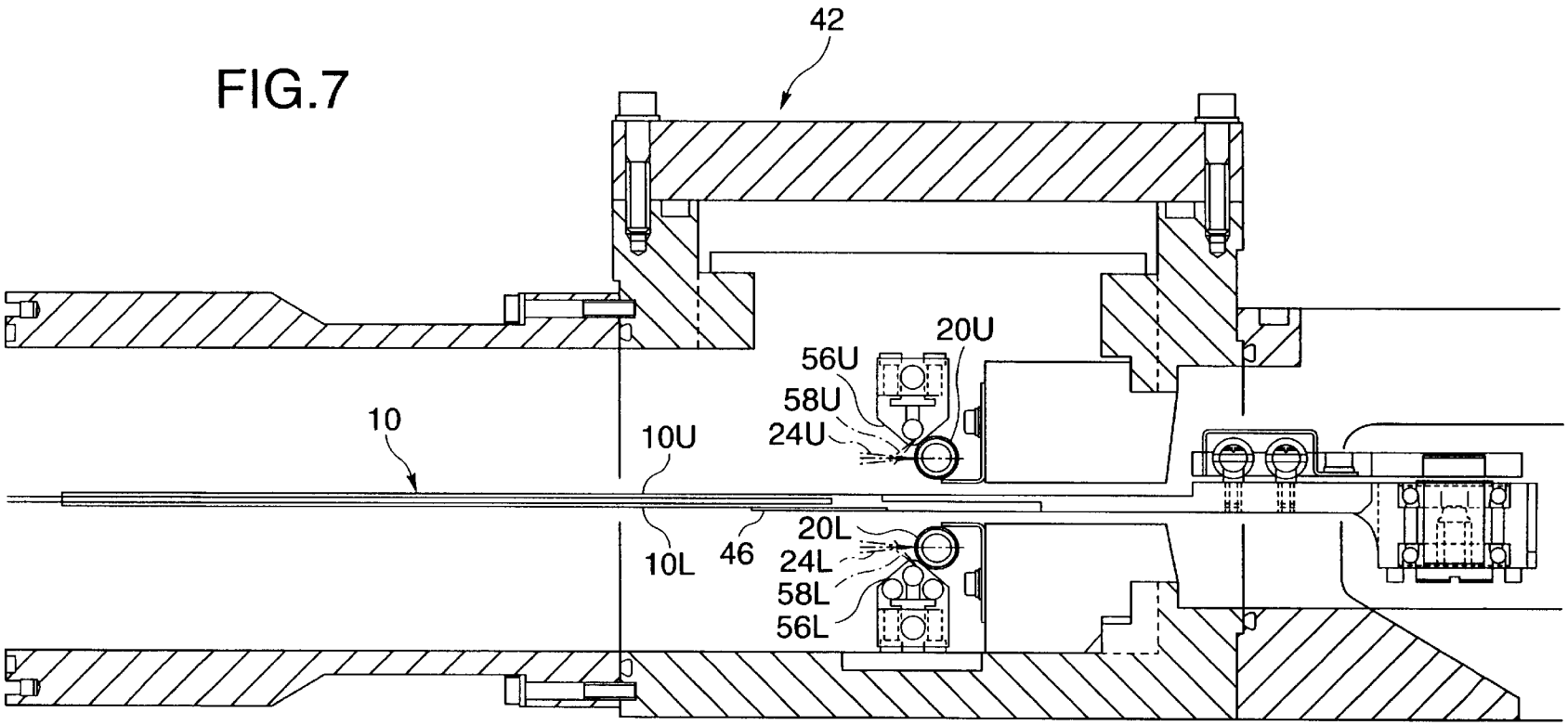
FIG. 7 is a vertical cross sectional view illustrating the vicinity of a nozzle in a cleaning chamber according to a first embodiment of the present invention.
Figure 8:
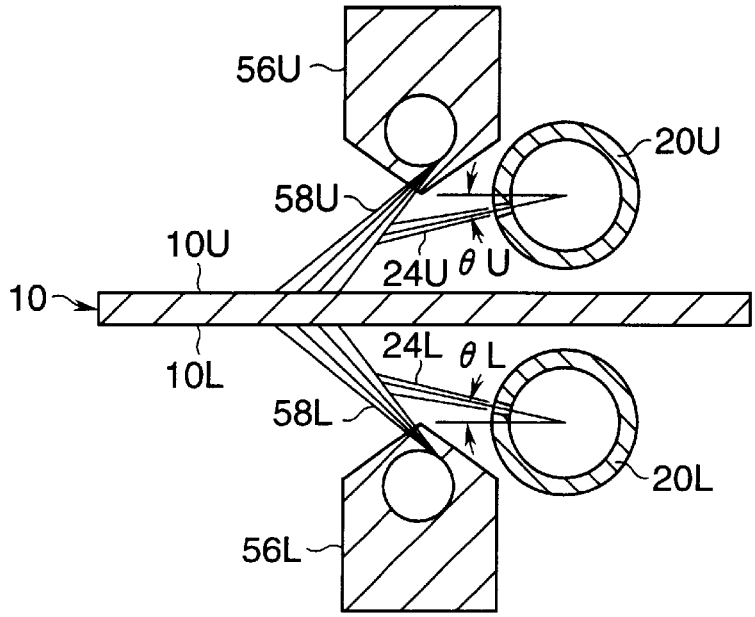
FIG. 8 is an enlarged cross sectional view illustrating the vicinity of the nozzle of the same.

A first embodiment of the present invention is illustrated in FIG. 7 (which is a vertical cross sectional view of the vicinity of a nozzle in a cleaning chamber), and in FIG. 8 (which is an enlarged cross sectional view of the vicinity of the nozzle) . As shown in these drawings, a wafer 10 is held horizontally and transferred by a process hand 46. Cleaning nozzles 20U, 20L are provided on both upper and lower sides of the wafer 10. The upper cleaning nozzle 20U is for cleaning the upper (or front side) of the wafer, while the lower cleaning nozzle 20L is for cleaning the lower (or backside) of the wafer. In the vicinity of each of the cleaning nozzles 20U, 20L are provided an upper side (front side) acceleration nozzle 56U and a lower side (backside) acceleration nozzle 56L, for accelerating aerosol 24U, 24L respectively ejected from each cleaning nozzle 20U, 20L, and for changing the direction of the aerosol toward surfaces to be cleaned of the wafer 10 (the front surface 10U and the back surface 10L).

In this embodiment, aerosols 24U, 24L ejected from the cleaning nozzles 20U, 20L are accelerated by acceleration gases 58U, 58L ejected from the acceleration nozzles 56U, 56L with a fast velocity of almost sonic speed. The gas jets 58U, 58L not only accelerate the aerosols but also change their directions towards the front surface 10U and the back surface 10L of the wafer 10, respectively, so that the aerosols are sprayed onto both surfaces 10L, 10U of the wafer 10. Thus an accelerated aerosol is collided against the front and back surfaces of the wafer in an appropriate direction for removing particles on the surfaces to be cleaned.

The provision of cleaning nozzles 20U, 20L on both upper and lower sides of the wafer 10 as in this embodiment enables both the front surface 10U and the back surface 10L of the wafer 10 at the same time by the ejected aerosols 20U, 20L. Thereby, the problems of cross-contamination such as particles moving from the backside toward the front side of the wafer, or other transfer of contaminants, which problems were encountered by prior art wafer cleaning techniques, and were unavoidable particularly in the conventional wet bath cleaning process using pure water, are all resolved.

Figure 9:
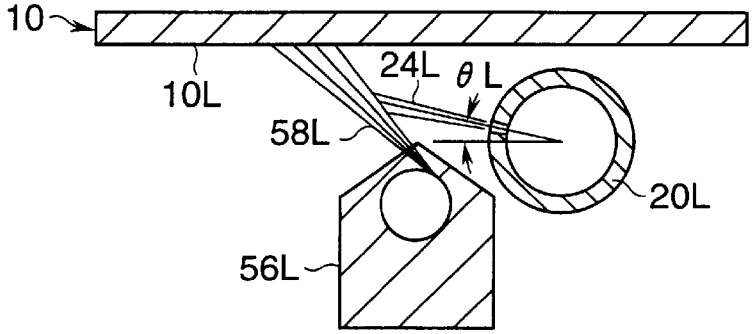
FIG. 9 is an enlarged cross sectional view of the vicinity of the nozzle according to a second embodiment of the present invention.

It should be noted that the upper cleaning nozzle 20U and the acceleration nozzle 56L can be omitted as in the second embodiment illustrated in FIG. 9, in which only the back surface 10L of the wafer 10 is cleaned using the lower cleaning nozzle 20L and the acceleration nozzle 56L.

The acceleration gases 58U, 58L in the above-described first embodiment can be ejected at variable velocities which are as high as sonic speed and in various directions, so as to guide the aerosols 24U, 24L in any spraying directions. Therefore, no limitations are imposed on the angles of the nozzles for ejecting the aerosols (which are typically set to be $\theta_U$=45° for the downward ejection and $\theta_L$=30° for the upward ejection) for ensuring stable ejection of aerosols. Thus aerosols 24U, 24L are sprayed onto the front surface 10U or the back surface 10L of the wafer 10 at any given inclined angle, whereby efficient cleaning is achieved. This is particularly effective for cleaning the backside 10L of the wafer 10 from underneath. Without the acceleration nozzles, the aerosols must travel a longer distance from ejection point of the cleaning nozzle to the surfaces of the wafer, resulting in reduction in the velocity of the stream of aerosol impinging against the wafer surfaces, in which case the particles held tightly on the wafer surfaces can hardly be removed.

Figure 10:
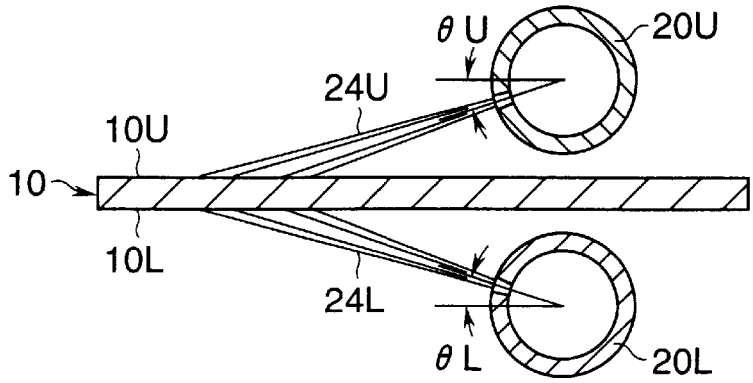
FIG. 10 is an enlarged cross sectional view of the vicinity of the nozzle according to a third embodiment of the present invention.

When the cleaning is intended for the removal of loosely held particles on the wafer surfaces, and if a satisfactory result would be achieved by ejecting the aerosols from the cleaning nozzles at predetermined fixed angles, for example, of $\theta_U$=45° or smaller for the downward ejection and $\theta_L$=30° or smaller for the upward ejection, then the acceleration nozzles can be dispensed with, as in the third embodiment illustrated in FIG. 10.

Next, a fourth embodiment of the present invention, and particularly the upper nozzle as one example, will be described in detail.

Figure 11:
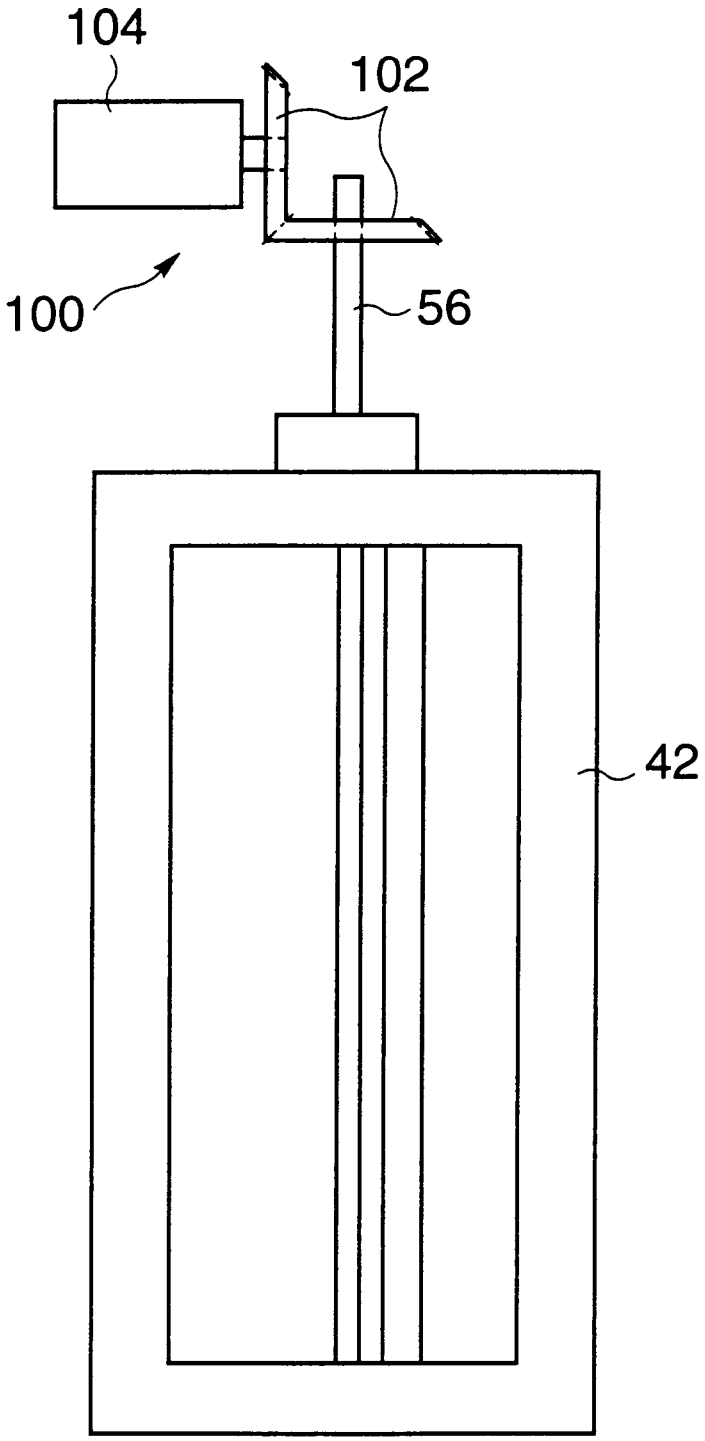
FIG. 11 is a horizontal cross sectional view illustrating the vicinity of a cleaning chamber according to a fourth embodiment of the present invention.
Figure 12:
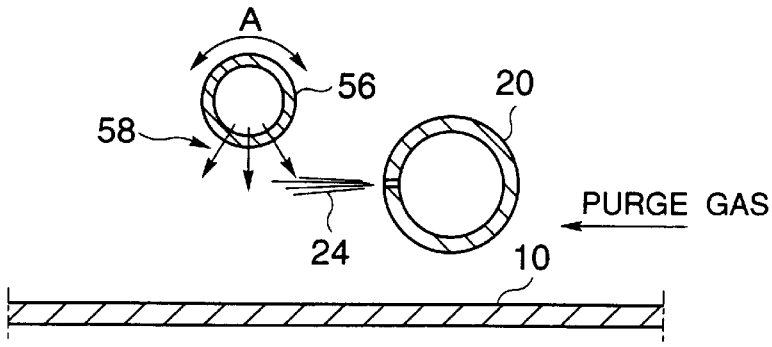
FIG. 12 is an enlarged cross sectional view illustrating the vicinity of the nozzle.

In this embodiment, as shown in FIG. 11 (plan view) and in FIG. 12 (enlarged cross sectional view illustrating the vicinity of the upper nozzle), the acceleration nozzle 56 is provided at one end thereof with an acceleration nozzle angle adjusting mechanism 100 composed of, for example, a bevel gear 102 and a motor 104, so that the acceleration nozzle 56 can rotate about its axis as indicated by the arrow A in FIG. 12. Meanwhile, a stream of aerosol 24 ejected from the cleaning nozzle 20 is directed substantially horizontally toward just below the acceleration nozzle 56. In this way, the stream of aerosol 24 can be directed toward the wafer surface at any desired angle by changing the angle of the acceleration gas 58 ejected from the acceleration nozzle 56.

Figure 1:
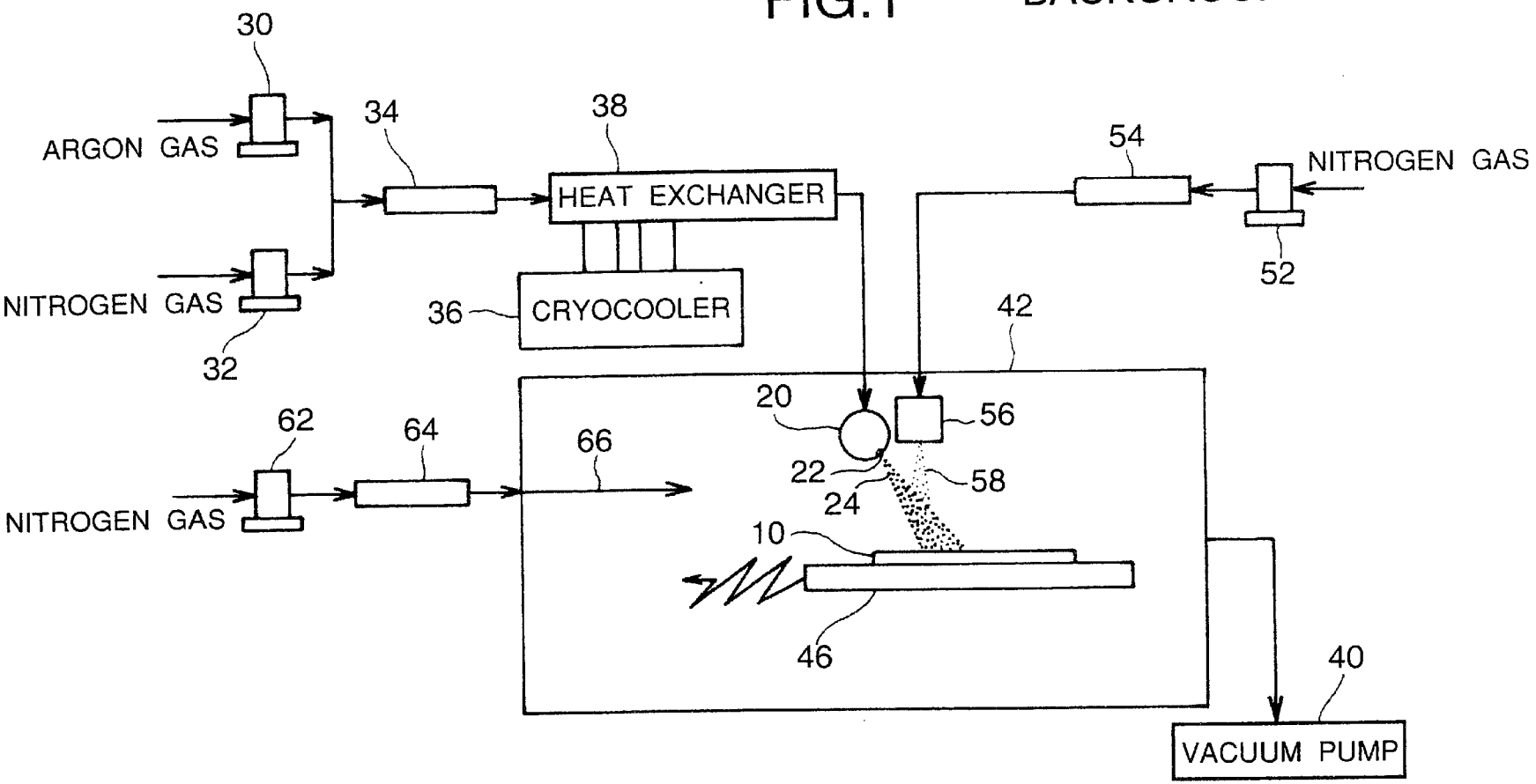
FIG. 1 is a piping diagram illustrating the entire construction of one example of a wafer cleaning apparatus using an aerosol, to which the present invention is applied.
Figure 2:
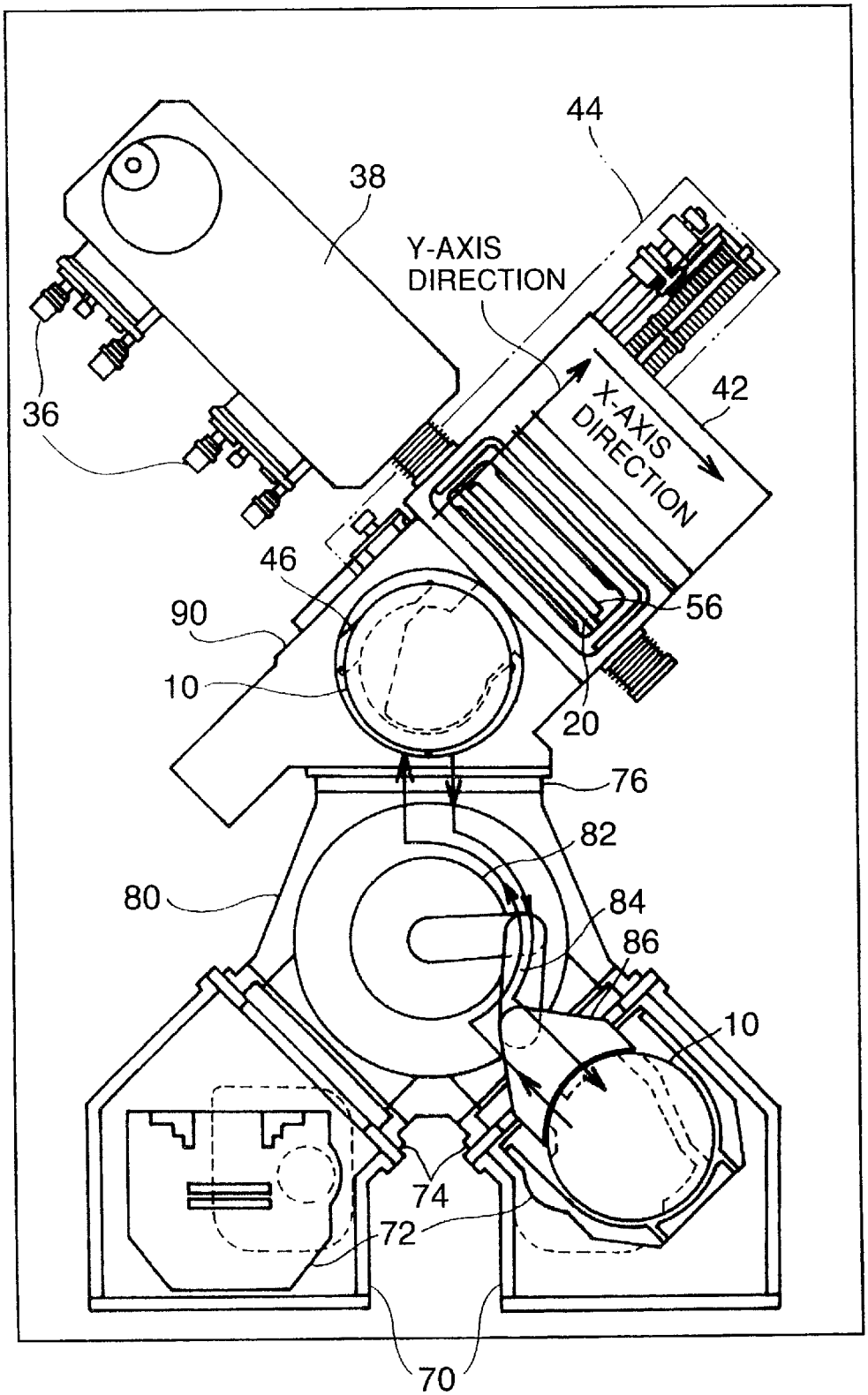
FIG. 2 is a plan view of the same.
Figure 3:
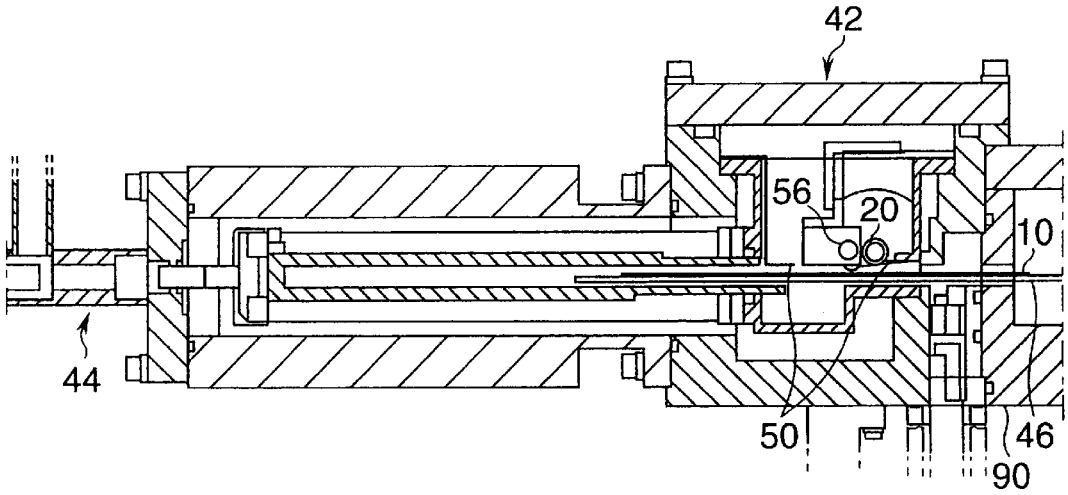
FIG. 3 is a vertical cross sectional view of a cleaning chamber of the same.
Figure 4:
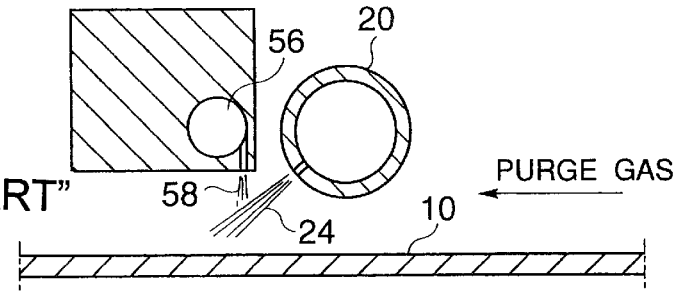
FIG. 4 is an enlarged cross sectional view illustrating the vicinity of a nozzle of the same.
Figure 5:
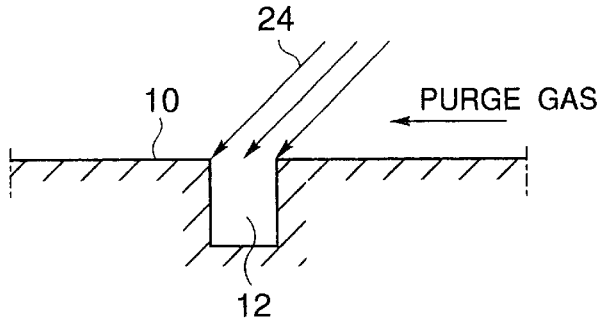
FIG. 5 is an enlarged cross sectional view illustrating the vicinity of a wafer surface given in explanation of the problem when via holes are present.
Figure 6:
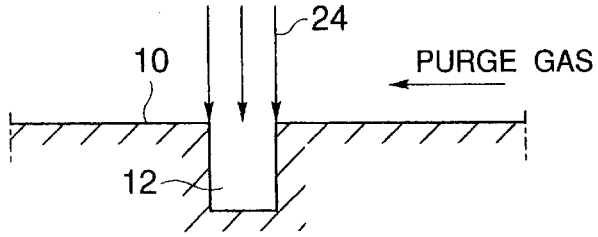
FIG. 6 is an enlarged cross sectional view of the vicinity of a wafer surface illustrating a direction in which aerosol should be directed when via holes are present.
Figure 13:
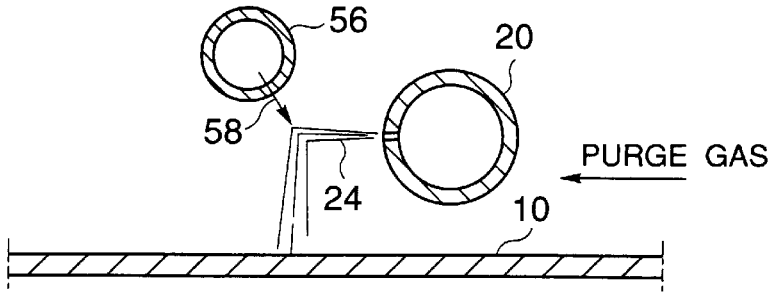
FIG. 13 is an enlarged cross sectional view of the vicinity of the nozzle according to the fourth embodiment illustrating a jet of aerosol directed vertically onto the wafer surface.

For example, in order to thoroughly clean the inside of via holes 12 shown in FIG. 6, the acceleration nozzle 56 may be positioned as shown in FIG. 13 so as to cause the acceleration gas 58 ejected from the acceleration nozzle 56 to collide with the aerosol 24 from a substantially opposite direction, whereby the aerosol 24 blown out horizontally from the cleaning nozzle 20 changes its course to reach the wafer 10 from a substantially vertical direction.

Figure 14:
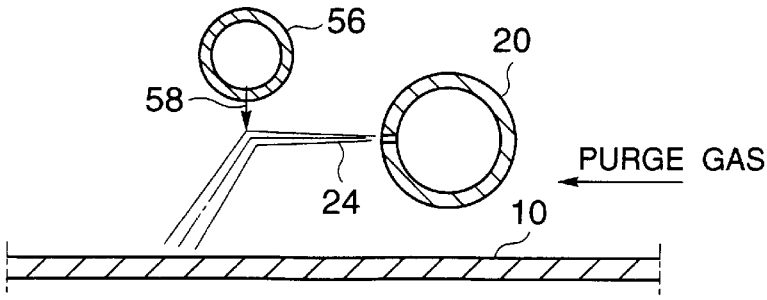
FIG. 14 is an enlarged cross sectional view of the vicinity of the nozzle likewise illustrating a jet of aerosol directed obliquely onto the wafer surface.

On the other hand, in order to minimize the number of residual particles, the acceleration nozzle 56 is rotated to a position shown in FIG. 14 so as to cause the acceleration gas 58 to collide with the aerosol 24 from above, whereby the aerosol 24 is directed obliquely onto the wafer surface.

While the cleaning nozzle is kept cooled, the acceleration nozzle is maintained at normal temperature, and therefore the acceleration nozzle can change its angle for ejecting the gas without presenting any of the problems mentioned in the foregoing. The acceleration nozzle angle is adjustable irrespective of the step of generating aerosol, which means the angle of the impinging stream of aerosol toward the surface to be cleaned is changeable even during the cleaning. For example, the aerosol may be first directed vertically toward the wafer surface to clean the inside of the recesses or holes, and then be directed obliquely later so as to remove residual particles as much as possible.

Although the upper nozzle has been described in the above description, it should go without saying that the same arrangement can be adopted for the lower nozzle.

In this embodiment, the ejection angle of the acceleration gas is changed by rotating the acceleration nozzle 56, whereby the control of the aerosol directions is achieved with a simple construction. It should be noted that the method of changing the acceleration gas ejection angle should not be limited to the example given above, nor is the method of changing the ejection course of aerosol using the acceleration gas. For example, the direction in which the aerosol is sprayed onto the surface to be cleaned can also be changed by changing the speed of the acceleration gas. In the fourth embodiment, the wafer 10 should not necessarily be held horizontally, but may be held upright.

According to this embodiment, because of the simple and reliable arrangement for adjusting the direction of aerosol sprayed onto an object to be cleaned, aerosol can be delivered in suitable directions in accordance with the types and the structures of the object to be cleaned. This offers a greater degree of flexibility in the way cleaning process is designed, with various features of the aerosol cleaning being advantageously used, and allows a wider scope of applications of the aerosol cleaning.

In the various embodiments described above, argon aerosol is used for the aerosol and nitrogen gas is used for the acceleration gas, but the types of the aerosol and the acceleration gas should not be limited to this example.

Also, although the present invention has been shown to be applied as a cleaning apparatus for semiconductor wafers in the embodiments described above, the application of the present invention is not limited thereto, and the present invention can of course be applied to a cleaning apparatus of semiconductor masks, flat panel substrates, magnetic disk substrates, flying head substrates, and others.

INDUSTRIAL APPLICABILITY

The present invention solves the contamination problems encountered by the conventional wet bath cleaning processes, such as contaminants on the backside of the wafer, transfer of particles to the front surface of the wafer, and the problem of particles sputtered from the front surface of the wafer by aerosol cleaning being deposited on the backside of the wafer during surface cleaning.

What is claimed is:

1. A method of cleaning by spraying a cleaning fluid to a surface to be cleaned, comprising cleaning a lower side of a substantially semiconductor wafer, which is held substantially perpendicular to the direction of gravity, by spraying the cleaning fluid, which comprises an aerosol containing argon particles, upwards from below the semiconductor wafer toward the lower side of the semiconductor wafer, wherein said aerosol is accelerated by an accelerating fluid ejected from an acceleration nozzle provided independently of a cleaning nozzle for spraying said aerosol.

2. The method of cleaning by spraying a cleaning fluid according to claim 1, wherein the spraying direction of said aerosol toward the surface to be cleaned is changed during the cleaning by contacting with said accelerating fluid.

3. The method of cleaning by spraying a cleaning fluid according to claim 2, wherein said accelerating fluid can be ejected at variable speeds and in variable directions for controlling the spraying direction of said aerosol toward the surface to be cleaned.

4. A method of cleaning by spraying a cleaning fluid to a surface to be cleaned, comprising cleaning a lower side and an upper side of a semiconductor wafer, which is held substantially perpendicular to the direction of gravity, at the same time by spraying an aerosol containing argon particles upwards from below the semiconductor wafer toward the lower side of the semiconductor wafer and by spraying said aerosol downwards from above the semiconductor wafer toward the upper side of said semiconductor wafer, wherein the aerosol to be sprayed onto the lower side of said semiconductor wafer is accelerated by an accelerating fluid ejected from below the semiconductor wafer from an acceleration nozzle provided independently of a cleaning nozzle for spraying said aerosol.

5. The method of cleaning by spraying a cleaning fluid according to claim 4, wherein the aerosol to be sprayed onto the upper side of said semiconductor wafer is also accelerated by an accelerating fluid ejected from an acceleration nozzle provided independently of a cleaning nozzle for spraying said aerosol to spray it onto the surface to be cleaned.

6. The method of cleaning by spraying a cleaning fluid according to claim 4, wherein the spraying direction of said aerosol toward the surface to be cleaned is changed during the cleaning by contacting with said accelerating fluid.

7. The method of cleaning by spraying a cleaning fluid according to claim 6, wherein said accelerating fluid can be ejected at variable speeds and in variable directions during the cleaning for controlling the spraying direction of said aerosol toward the surface to be cleaned.

8. A method of cleaning by spraying an aerosol cleaning fluid to a surface to be cleaned of an object to be cleaned, comprising accelerating said aerosol cleaning fluid by an accelerating fluid of which direction can be varied during the accelerating, and contacting the accelerating fluid with cleaning fluid to change spraying direction of cleaning fluid toward the surface to be cleaned, before being sprayed onto said surface to be cleaned.

9. An apparatus for cleaning by spraying a cleaning fluid to a surface to be cleaned comprising;

means for holding a semiconductor wafer, which is held substantially perpendicular to the direction of gravity, within a sealed system, a source of an aerosol containing argon particles in communication with the sealed system;

a cleaning nozzle that sprays the aerosol containing argon particles upwards from below the semiconductor wafer against a lower side of the substantially horizontally-held semiconductor wafer, a source of an acceleration fluid in communication with the sealed system;

an acceleration nozzle that sprays the acceleration fluid accelerating the aerosol ejected from said cleaning nozzle, the acceleration nozzle being provided independently of said cleaning nozzle.

10. The apparatus for cleaning by spraying a cleaning fluid according to claim 9, further comprising means for changing one or both of a speed and direction of an accelerating fluid ejected from said acceleration nozzle.

11. An apparatus for cleaning by spraying a cleaning fluid to a surface to be cleaned, comprising means for holding within a sealed system a semiconductor wafer substantially perpendicular to the direction of gravity, a lower side cleaning nozzle, within said sealed system, that sprays said cleaning fluid, which is an aerosol containing argon particles, upwards from below the semiconductor wafer against a lower side of the semiconductor wafer, a lower side acceleration nozzle, within said sealed system, that accelerates the aerosol ejected from said lower side cleaning nozzle, the lower side acceleration nozzle being provided independently of said lower side cleaning nozzle, and an upper side cleaning nozzle, within said sealed system, that sprays said aerosol downwards from above the semiconductor wafer against an upper side of said semiconductor wafer.

12. The apparatus for cleaning by spraying a cleaning fluid according to claim 11, further comprising an acceleration nozzle for accelerating the aerosol ejected from said upper side cleaning nozzle, the upper side acceleration nozzle being provided independently of said upper side cleaning nozzle.

13. The apparatus for cleaning by spraying a cleaning fluid according to claim 12, further comprising means for changing one or both of a speed and direction of an accelerating fluid ejected from said acceleration nozzle.

14. An apparatus for cleaning by spraying an aerosol cleaning fluid to a surface to be cleaned of an object to be cleaned, comprising;

means for holding the object to be cleaned within a sealed system, a cleaning nozzle within the sealed system that sprays said aerosol cleaning fluid against the surface to be cleaned of the object to be cleaned, an acceleration nozzle within the sealed system that ejects an accelerating fluid that changes, during the spraying, the spraying direction of the aerosol cleaning fluid ejected from said cleaning nozzle toward the surface to be cleaned, and means within the sealed system that changes direction of the accelerating fluid ejected from said acceleration nozzle during the spraying.

* * * * *